US010293907B2

(12) United States Patent
Kitajima et al.

(10) Patent No.: US 10,293,907 B2
(45) Date of Patent: May 21, 2019

(54) OUTBOARD MOTOR

(71) Applicant: YAMAHA HATSUDOKI KABUSHIKI KAISHA, Iwata-shi, Shizuoka (JP)

(72) Inventors: Kazuyuki Kitajima, Shizuoka (JP); Shinichi Hoshiya, Shizuoka (JP); Masayuki Aritou, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/795,428

(22) Filed: Oct. 27, 2017

(65) Prior Publication Data

US 2018/0178891 A1 Jun. 28, 2018

(30) Foreign Application Priority Data

Dec. 28, 2016 (JP) ..... 2016-256647

(51) Int. Cl.

| | |
|---|---|
| ***B63H 20/14*** | (2006.01) |
| ***F02B 61/04*** | (2006.01) |
| ***F02D 29/02*** | (2006.01) |
| *F02B 61/06* | (2006.01) |

(52) U.S. Cl.

CPC ..... *B63H 20/14* (2013.01); *F02B 61/045* (2013.01); *F02D 29/02* (2013.01); *F02B 61/06* (2013.01)

(58) Field of Classification Search

CPC .. B63H 20/14; B63H 2020/145; B63H 20/16; B63H 20/18; B63H 20/20; B63H 20/22

See application file for complete search history.

(56) References Cited

U.S. PATENT DOCUMENTS

| | | | | |
|---|---|---|---|---|
| 4,559,018 | A * | 12/1985 | Nakahama | B63H 20/14 248/642 |
| 4,615,683 | A * | 10/1986 | Harada | F02B 61/045 440/52 |
| 8,490,594 | B2 | 7/2013 | Kitajima | |
| 8,851,946 | B2 * | 10/2014 | Kuriyagawa | B63H 20/14 440/1 |
| 2011/0195620 | A1 | 8/2011 | Davis et al. | |
| 2012/0034828 | A1 * | 2/2012 | White | B63H 20/007 440/53 |
| 2016/0236763 | A1 * | 8/2016 | Achiwa | B63H 20/285 |

FOREIGN PATENT DOCUMENTS

| | | | |
|---|---|---|---|
| JP | 04-17835 | B2 | 3/1992 |
| JP | 2000-168689 | A | 6/2000 |
| JP | 3307233 | B2 | 7/2002 |
| JP | 5850461 | B2 | 2/2016 |
| RU | 2 330 788 | C1 | 8/2008 |
| SU | 234875 | A1 | 9/1972 |

OTHER PUBLICATIONS

Official Communication issued in corresponding Russian Patent Application No. 2017145070/11(077196), dated Aug. 8, 2018.

* cited by examiner

*Primary Examiner* — Andrew Polay

(74) *Attorney, Agent, or Firm* — Keating and Bennett, LLP

(57) ABSTRACT

An outboard motor includes an engine including a crankshaft that extends in a horizontal or substantially horizontal direction and perpendicular or substantially perpendicular to a direction of a thrust force, a cylinder, a first gear provided on a balance shaft disposed in a direction that intersects with a direction in which the cylinder extends, a second gear, a drive shaft, and a propeller.

18 Claims, 3 Drawing Sheets

OUTBOARD MOTOR

CROSS REFERENCE TO RELATED APPLICATIONS

This application claims the benefit of priority to Japanese Patent Application No. 2016-256647 filed on Dec. 28, 2016. The entire contents of this application are hereby incorporated herein by reference.

BACKGROUND OF THE INVENTION

1. Field of the Invention

The present invention relates to an outboard motor, and more particularly, it relates to an outboard motor including an engine.

2. Description of the Related Art

An outboard motor including an engine is known in general. Such an outboard motor is disclosed in Japanese Patent No. 5850461, for example.

Japanese Patent No. 5850461 discloses an outboard motor including an engine including a crankshaft that extends in a forward-rearward direction parallel to the direction of a thrust force and a plurality of transmissions that transmit a driving force of the crankshaft to a propeller.

In the outboard motor disclosed in Japanese Patent No. 5850461, the crankshaft extends in the forward-rearward direction parallel to the direction of the thrust force, and hence cylinders of the engine are aligned in the forward-rearward direction. Consequently, the size of the engine in the forward-rearward direction increases, and hence the size of the outboard motor in the forward-rearward direction disadvantageously increases.

SUMMARY OF THE INVENTION

Preferred embodiments of the present invention provide outboard motors that significantly reduce or prevent an increase in their size in a forward-rearward direction due to the orientation of an engine.

An outboard motor according to a preferred embodiment of the present invention includes an engine including a cylinder in which a piston reciprocates and a crankshaft to which reciprocating movement of the piston is transmitted as a rotational motion, the crankshaft extending in a horizontal or substantially horizontal direction and perpendicular or substantially perpendicular to a direction of a thrust force of the outboard motor, a balance shaft disposed in a direction that intersects with a direction in which the cylinder extends and in a downward direction with respect to the crankshaft, the balance shaft extending parallel or substantially parallel to a direction in which the crankshaft extends, the balance shaft receiving a driving force from the crankshaft, a first gear provided on the balance shaft, a second gear to which a decelerated rotational force from the first gear is transmitted, a drive shaft connected to the second gear and extending in an upward-downward direction, and a propeller rotated by a driving force from the drive shaft.

In an outboard motor according to a preferred embodiment of the present invention, the crankshaft extends in the horizontal or substantially horizontal direction and perpendicular or substantially perpendicular to the direction of the thrust force such that a plurality of cylinders are aligned in a right-left direction perpendicular or substantially perpendicular to a forward-rearward direction. Thus, an increase in the size of the outboard motor in the forward-rearward direction due to the orientation of the engine is significantly reduced or prevented. The rotational axis of the crankshaft extends in the right-left direction, and compared with the case where the rotational axis of the crankshaft extends in the upward-downward direction, vibrations in a steering direction are significantly reduced or prevented. The cylinders are aligned in the horizontal or substantially horizontal direction, and compared with the case where the rotational axis of the crankshaft extends in the upward-downward direction and the cylinders are aligned in the upward-downward direction, the center of gravity is lowered. Thus, a vessel body on which the outboard motor is mounted is stabilized, and the operability of the outboard motor is improved. The rotational axis of the crankshaft extends in the right-left direction and, thus, the rolling of the vessel body on which the outboard motor is mounted is significantly reduced or prevented due to the gyro effect (the effect of stabilizing the attitude of a rotating object). Thus, the attitude of the vessel body is stabilized. The outboard motor includes the first gear disposed on the balance shaft and the second gear to which the decelerated rotational force from the first gear is transmitted. Thus, the rotational speed of the engine is reduced and transmitted to the propeller, and the rotational speed of the engine is increased with respect to the upper limit of the rotational speed of the propeller which does not cause cavitation. Consequently, the engine is able to be driven at a higher speed. Thus, the rotational speed is increased such that the output of the engine is increased, and the engine is downsized. The rotational speed of the engine is reduced and transmitted to the propeller such that the rotational speed (idle rotational speed) of the engine during idling is increased, and when the engine is at the idle rotational speed, the vessel speed is reduced while a reduction in the amount of power generated is significantly reduced or prevented. This advantageous effect is beneficial when an electronic device such as a fish finder is used while the vessel body trolls at a very low speed, for example. The balance shaft is disposed in the direction that intersects with the direction in which the cylinder extends and in the downward direction with respect to the crankshaft such that it is not necessary to provide a space to dispose the balance shaft in the direction in which the cylinder extends, and an increase in the size of the outboard motor in the forward-rearward direction in which the cylinder extends is further significantly reduced or prevented.

In an outboard motor according to a preferred embodiment of the present invention, a rotational speed of the second gear is preferably reduced to about ½ times or more and about 1/1.5 times or less than a rotational speed of the first gear, for example. Accordingly, as compared with the case where the rotational speed is not reduced, the engine is rotated at a higher speed, the engine is effectively downsized, and the idle rotational speed is effectively increased.

In this case, an outboard motor according to a preferred embodiment of the present invention preferably further includes a third gear that decelerates the rotational speed of the drive shaft and transmits a decelerated rotational force to the propeller, and a reduction ratio of the third gear, which is a ratio of an output rotational speed to an input rotational speed, is preferably less than reduction ratios of the first gear and the second gear. Accordingly, the rotational speed of the engine is further reduced and a rotational force is transmitted to the propeller by the third gear.

In the structure further including the third gear, the third gear preferably reduces a rotational speed of the propeller to about 1/2.5 times or more and about ½ times or less than a rotational speed of the drive shaft, for example. Accordingly, a rotational force of the drive shaft is transmitted to the propeller in a state where the torque is increased.

In an outboard motor according to a preferred embodiment of the present invention, the first gear is preferably integral with the balance shaft. Accordingly, the rotational speed of the balance shaft is directly reduced by the first gear, and compared with the case where a transmission such as a gear is separately provided, the number of components is reduced, and it is not necessary to provide a space to dispose the transmission such that the engine is downsized.

In an outboard motor according to a preferred embodiment of the present invention, the first gear and the second gear each preferably include a bevel gear. Accordingly, the rotational speed of the second gear is reduced while the rotation of the first gear about the axis in the horizontal direction is efficiently converted into the rotation of the second gear about the axis in the upward-downward direction.

In an outboard motor according to a preferred embodiment of the present invention, the cylinder preferably includes two or less cylinders. Accordingly, an increase in the size of the outboard motor in the right-left direction in which the crankshaft extends is significantly reduced or prevented.

In a preferred embodiment of the present invention, the cylinder preferably includes only one cylinder. Accordingly, the outboard motor is effectively downsized in the right-left direction in which the crankshaft extends.

In an outboard motor according to a preferred embodiment of the present invention, the engine preferably has an output of about 70 horsepower or less, for example. Accordingly, the outboard motor having an output of about 70 horsepower or less is downsized in the forward-rearward direction.

An outboard motor according to a preferred embodiment of the present invention preferably further includes a tiller handle including a throttle grip that adjusts an accelerator opening degree of the engine, and the tiller handle steers the direction of the thrust force. Accordingly, the outboard motor that an operator manually steers is downsized in the forward-rearward direction, and thus the center of gravity in the forward-rearward direction is closer to the throttle grip. Thus, the rotational moment in the steering direction is reduced, and the operator is able to easily steer the outboard motor with a small force.

An outboard motor according to a preferred embodiment of the present invention preferably further includes a bracket that mounts the outboard motor on a vessel body, and the first gear and the second gear are preferably disposed above an upper end of the bracket. Accordingly, a speed reducer including the first gear and the second gear is disposed in an upper portion of the outboard motor, and thus it is possible to make lower components including the drive shaft common with components of a conventional outboard motor.

In this case, an outboard motor according to a preferred embodiment of the present invention preferably further includes a plurality of supports connected to the bracket and spaced apart from each other in the upward-downward direction, and an upper one of the plurality of supports is preferably disposed near the balance shaft. Accordingly, the vibrations of the engine are significantly reduced or prevented by the balance shaft, and thus transmission of the vibrations to the upper one of the plurality of supports disposed near the balance shaft is effectively significantly reduced or prevented.

In an outboard motor according to a preferred embodiment of the present invention, a rotational axis of the crankshaft is preferably disposed forward of a rotational axis of the balance shaft. Accordingly, the position of the balance shaft does not protrude forward, and thus an increase in the size of the outboard motor in the forward-rearward direction is easily significantly reduced or prevented.

In an outboard motor according to a preferred embodiment of the present invention, the crankshaft is preferably disposed forward of the cylinder. Accordingly, the position of the cylinder does not protrude forward relative to the crankshaft located in a front portion of the outboard motor, and thus an increase in the size of the outboard motor in the forward-rearward direction is easily significantly reduced or prevented.

In an outboard motor according to a preferred embodiment of the present invention, the cylinder preferably extends at an angular direction within about 30 degrees, for example, with respect to the horizontal direction. Accordingly, the cylinder does not extend excessively in the upward-downward direction, and thus an increase in the height of the center of gravity of the engine is significantly reduced or prevented, and an increase in the size of the outboard motor in the upward-downward direction is significantly reduced or prevented.

An outboard motor according to a preferred embodiment of the present invention preferably further includes an intake pipe that is connected to the cylinder and extends upward, and an exhaust pipe that is connected to the cylinder and extends downward. Accordingly, the engine efficiently takes in air from above and efficiently discharges exhaust gas downward, and thus the resistance to flow of intake air and exhaust gas is reduced, and the engine is efficiently driven.

An outboard motor according to a preferred embodiment of the present invention preferably further includes a flywheel that is connected to the crankshaft and rotates about an axis extending in the horizontal or substantially horizontal direction and perpendicular or substantially perpendicular to a propelling direction of the propeller. Accordingly, it is not necessary to elevate the position of the flywheel, which has a large mass, and thus the center of gravity of the outboard motor is effectively lowered.

In an outboard motor according to a preferred embodiment of the present invention, the engine is preferably rotationally driven at about 7000 rpm or more, for example. Accordingly, the engine of the outboard motor is driven at a high rotational speed.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of an outboard motor 100 according to preferred embodiments of the present invention is now described with reference to FIGS. 1 to 3. In the figures, arrow FWD represents the forward movement direction (front) of a vessel body 200 on which the outboard motor 100 is mounted, and arrow BWD represents the reverse movement direction (rear) of the vessel body 200.

Figure 1:
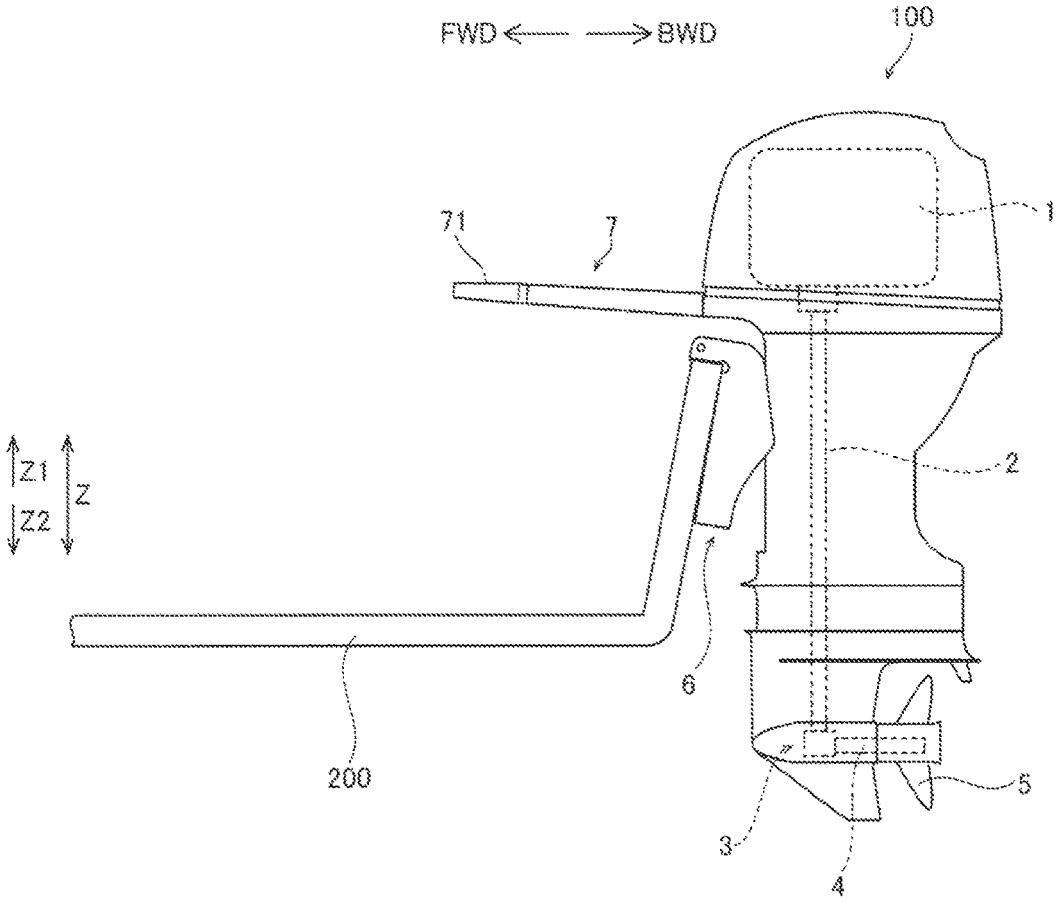
FIG. 1 is a side elevational view showing an outboard motor and a vessel body according to a preferred embodiment of the present invention.

As shown in FIG. 1, the outboard motor 100 according to a preferred embodiment of the present invention is mounted on a rear portion of the vessel body 200. The outboard motor 100 includes an engine 1, a drive shaft 2, a gearing 3, a propeller shaft 4, a propeller 5, a bracket 6, and a tiller handle 7, for example. The outboard motor 100 is mounted on the vessel body 200 via the bracket 6 so as to be rotatable about an axis extending in an upward-downward direction and about an axis extending in a horizontal direction. The gearing 3 is an example of a "third gear".

Figure 2:
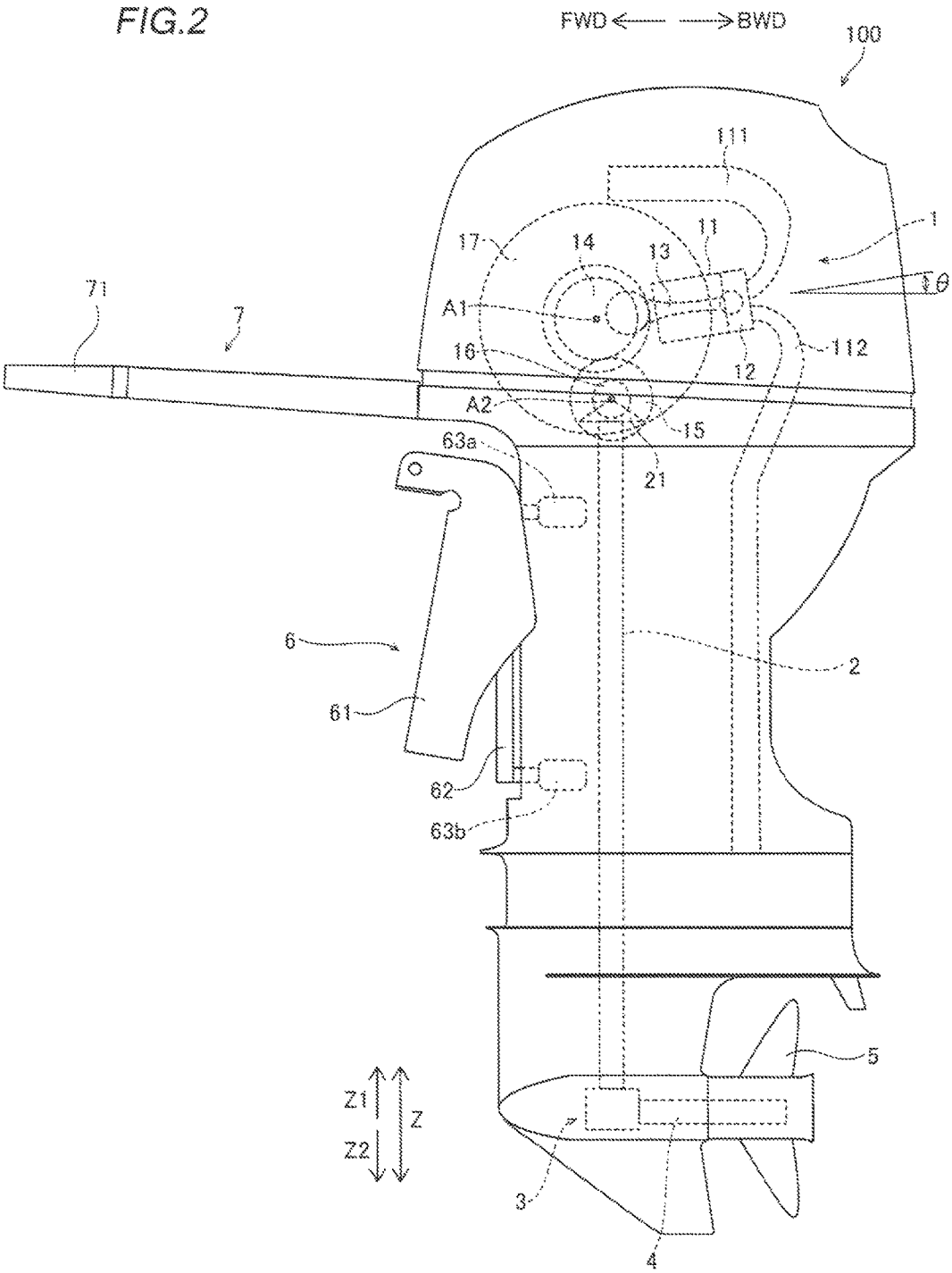
FIG. 2 is a side elevational view schematically showing an outboard motor according to a preferred embodiment of the present invention.
Figure 3:
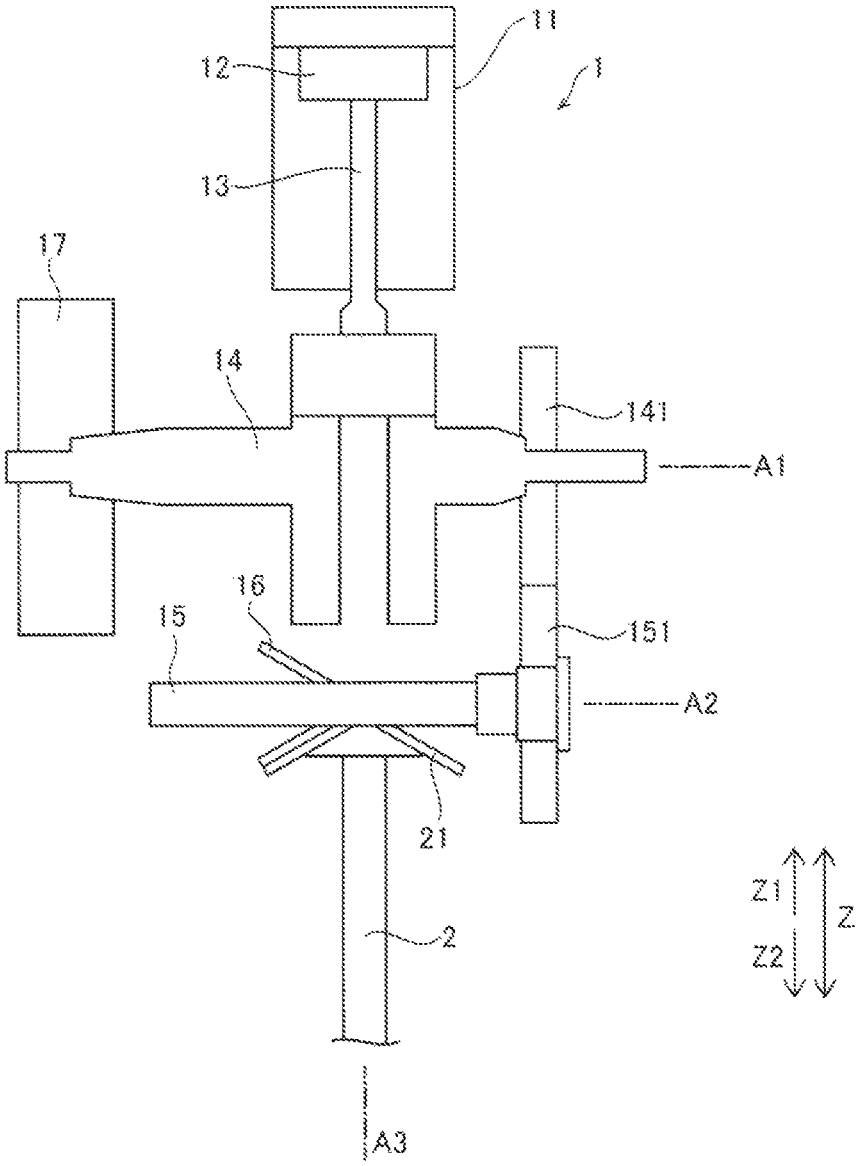
FIG. 3 is a front elevational view showing an engine of an outboard motor according to a preferred embodiment of the present invention.

As shown in FIGS. 2 and 3, the engine 1 includes a cylinder 11, a piston 12, a connecting rod 13, a crankshaft 14, a balance shaft 15, a first gear 16, and a flywheel 17. An intake pipe 111 and an exhaust pipe 112 are connected to the cylinder 11 of the engine 1. The drive shaft 2 includes a second gear 21. The bracket 6 includes a clamp bracket 61 and a swivel bracket 62. Supports 63*a* and 63*b* are connected to the bracket 6.

As shown in FIGS. 1 and 2, the engine 1 is provided in an upper portion of the outboard motor 100, and is preferably an internal combustion engine driven by explosive combustion of gasoline, light oil, or the like. The engine 1 preferably has an output of about 70 horsepower or less, for example. The engine 1 is preferably a four-stroke engine. The engine 1 is able to be rotationally driven at about 7000 rpm or more. That is, the engine 1 rotates at a high speed. The engine 1 preferably includes two or less cylinders 11, for example. The engine 1 may include only one cylinder 11, for example. Fuel and air are mixed and introduced into the cylinder 11, and the fuel is burned by ignition or spontaneous ignition to reciprocate the piston 12 inside the cylinder 11. The cylinder 11 extends at an angular θ direction within about 30 degrees, for example, with respect to the horizontal direction.

The intake pipe 111 is connected to the cylinder 11. The intake pipe 111 extends upward from the cylinder 11. The intake pipe 111 takes in air from above and supplies the air to the cylinder 11. The exhaust pipe 112 is connected to the cylinder 11. The exhaust pipe 112 extends downward from the cylinder 11. The exhaust pipe 112 discharges exhaust gas discharged from the cylinder 11 after combustion. The exhaust gas that passes through the exhaust pipe 112 is discharged outside the outboard motor 100 together with water that has cooled the engine 1.

The piston 12 is connected to a first end of the connecting rod 13. The crankshaft 14 is connected to a second end of the connecting rod 13. Thus, the reciprocating movement of the piston 12 is transmitted as a rotational motion to the crankshaft 14.

According to a preferred embodiment of the present invention, the crankshaft 14 extends in a horizontal or substantially horizontal direction and perpendicular or substantially perpendicular to the direction of a thrust force (a direction in which the propeller shaft 4 extends). That is, the crankshaft 14 extends in the right-left direction of the outboard motor 100. As shown in FIGS. 2 and 3, the crankshaft 14 is rotationally driven about a rotational axis A1. As shown in FIG. 2, the rotational axis A1 of the crankshaft 14 is disposed forward of the cylinder 11.

As shown in FIG. 3, a gear 141 is mounted on the crankshaft 14. The flywheel 17 is mounted on the crankshaft 14. The gear 141 meshes with a gear 151 mounted on the balance shaft 15. The gears 141 and 151 preferably include the same number of teeth and mesh with each other at a substantially constant speed. That is, the rotational speed of the crankshaft 14 and the rotational speed of the balance shaft 15 are equal or substantially equal to each other.

The balance shaft 15 is rotationally driven by a driving force transmitted from the crankshaft 14. Specifically, as shown in FIGS. 2 and 3, the balance shaft 15 is rotationally driven about a rotational axis A2. The balance shaft 15 reduces the vibration of the crankshaft 14. The balance shaft 15 includes an eccentric shaft.

As shown in FIG. 3, the balance shaft 15 extends parallel or substantially parallel to a direction in which the crankshaft 14 extends. That is, the rotational axis A2 of the balance shaft 15 and the rotational axis A1 of the crankshaft 14 are disposed parallel or substantially parallel to each other. As shown in FIG. 2, the balance shaft 15 extends in a direction that intersects with a direction in which the cylinder 11 extends and in a downward direction (direction Z2) with respect to the crankshaft 14.

The rotational axis A1 of the crankshaft 14 is disposed forward of the rotational axis A2 of the balance shaft 15. The rotational axis A1 of the crankshaft 14 is disposed above the rotational axis A2 of the balance shaft 15.

According to a preferred embodiment of the present invention, the first gear 16 is provided on the balance shaft 15, as shown in FIG. 2. Specifically, the first gear 16 is integral with the balance shaft 15. The first gear 16 is disposed at or substantially at the center of the balance shaft 15 in a direction in which the balance shaft 15 extends. The first gear 16 includes a bevel gear. The first gear 16 is rotated about the same rotational axis A2 as the balance shaft 15. The first gear 16 meshes with the second gear 21. The rotational speed of the first gear 16 is decelerated and the rotational force is transmitted to the second gear 21. The first gear 16 includes a number of teeth that is about ½ times or more and about 1/1.5 times or less the number of teeth of the second gear 21, for example. That is, the rotational speed of the second gear 21 is reduced to about ½ times or more and about 1/1.5 times or less the rotational speed of the first gear 16, for example.

The flywheel 17 is connected to the crankshaft 14. The flywheel 17 stabilizes the rotation of the crankshaft 14. The flywheel 17 is integral with a rotor of a power generator. In the flywheel 17, a permanent magnet is disposed. A stator of the power generator including a coil is disposed radially inwardly of the flywheel 17, and the power generator generates power due to the rotation of the flywheel 17. The flywheel 17 rotates about an axis in the horizontal or substantially horizontal direction and perpendicular or substantially perpendicular to the propelling direction of the propeller 5. Specifically, the flywheel 17 is rotated about the same rotational axis A1 as the crankshaft 14.

As shown in FIGS. 1 and 2, the drive shaft 2 extends in the upward-downward direction (direction Z). The drive shaft 2 is connected to the second gear 21, and the rotational motion of the engine 1 is transmitted to the drive shaft 2. As shown in FIG. 3, the drive shaft 2 is rotated about a rotational axis A3 that extends in the upward-downward direction. The drive shaft 2 is disposed below (direction Z2) the balance shaft 15. The drive shaft 2 is disposed substantially at the center of the balance shaft 15 in the direction in which the balance shaft 15 extends. In FIG. 3, the drive shaft 2 and the cylinder 11 (connecting rod 13) are schematically shown and disposed on the same plane for the purpose of illustration. However, as shown in FIG. 2, the axis of the drive shaft 2 and the cylinder 11 intersect with each other as viewed from a side surface direction.

The second gear 21 includes a bevel gear. The second gear 21 is rotated about the same rotational axis A3 as the drive shaft 2.

As shown in FIG. 2, the gearing 3 is disposed in a lower portion of the outboard motor 100. The gearing 3 decelerates the rotational speed of the drive shaft 2 and transmits the decelerated rotational force to the propeller shaft 4 (propeller 5). That is, the gearing 3 transmits the drive force of the drive shaft 2 that rotates about the rotational axis extending in the upward-downward direction to the propeller shaft 4 that rotates about a rotational axis extending in a forward-rearward direction.

Specifically, the gearing 3 includes a pinion gear, a forward movement bevel gear, a reverse movement bevel gear, and a dog clutch. The pinion gear is mounted on a lower end of the drive shaft 2. The forward movement bevel gear and the reverse movement bevel gear are provided on the propeller shaft 4 so as to sandwich the pinion gear therebetween. The pinion gear meshes with the forward movement bevel gear and the reverse movement bevel gear. The gearing 3 switches between a state where the dog clutch that rotates integrally with the propeller shaft 4 engages with the forward movement bevel gear and a state where the dog clutch engages with the reverse movement bevel gear so as to switch the shift position (the rotational direction (the forward movement direction and the reverse movement direction) of the propeller shaft 4). The gearing 3 is switched to a state where the dog clutch engages with neither the forward movement bevel gear nor the reverse movement bevel gear so as to change the shift position to neutral.

The reduction ratio of the gearing 3, which is a ratio of an output rotational speed to an input rotational speed, is less than the reduction ratios of the first gear 16 and the second gear 21. Specifically, the gearing 3 reduces the rotational speed of the propeller 5 to about 1/2.5 times or more and about ½ times or less the rotational speed of the drive shaft 2, for example.

The propeller 5 (screw) is connected to the propeller shaft 4. That is, the driving force of the drive shaft 2 is transmitted to the propeller 5, and the propeller 5 rotates. The propeller 5 is rotationally driven about a rotational axis that extends in the forward-rearward direction. The propeller 5 generates a thrust force in its axial direction by rotating in water. The propeller 5 moves the vessel body 200 forwardly or reversely according to its rotational direction.

As shown in FIGS. 1 and 2, the bracket 6 mounts the outboard motor 100 on the vessel body 200. The clamp bracket 61 of the bracket 6 is fixed to the stern of the vessel body 200. The clamp bracket 61 is fastened to the vessel body 200 by bolts and nuts, for example. The swivel bracket 62 is supported by the clamp bracket 61 so as to be rotatable about an axis in the horizontal direction (right-left direction) and rotatable about an axis in the upward-downward direction. As shown in FIG. 2, the first gear 16 and the second gear 21 are disposed above an upper end of the bracket 6.

The supports 63*a* and 63*b* are connected to the bracket 6. Specifically, the supports 63*a* and 63*b* are connected to the swivel bracket 62. The supports 63*a* and 63*b* are spaced apart from each other in the upward-downward direction. The supports 63*a* are disposed above, and the supports 63*b* are disposed below. The supports 63*a* disposed above are located near the balance shaft 15. A pair of supports 63*a* are provided. The pair of supports 63*a* are aligned in the right-left direction. A pair of supports 63*b* are provided. The pair of supports 63*b* are aligned in the right-left direction.

The upper supports 63*a* transmit the thrust force and steering force of the outboard motor 100. The lower supports 63*b* transmit the thrust force and steering force of the outboard motor 100, and isolate vibrations. For example, the upper supports 63*a* each include a linkage. The lower supports 63*b* each include an elastic member, and transmit a force while isolating vibrations. The positions of the upper supports 63*a* relative to the crankshaft 14 and the balance shaft 15 are adjusted such that the moment about an axis parallel or substantially parallel to the rotational axis of the crankshaft 14 is zero or becomes smaller.

As shown in FIG. 2, the tiller handle 7 steers the direction of the thrust force. Specifically, the tiller handle 7 extends in the forward-rearward direction. An operator grasps and rotates the tiller handle 7 in the right-left direction such that the outboard motor 100 is steered (rotated about the rotational axis in the upward-downward direction).

A throttle grip 71 is provided at the tip of the tiller handle 7. The throttle grip 71 adjusts the accelerator opening degree of the engine 1. Specifically, the throttle grip 71 is rotatable about a rotational axis in a direction in which the tiller handle 7 extends. The operator grasps and rotates the throttle grip 71 such that an operation to adjust the accelerator opening degree is received. The received accelerator opening degree operation is preferably transmitted to a throttle of the engine 1 via electronic control.

According to the various preferred embodiments of the present invention described above, the following advantageous effects are achieved.

According to a preferred embodiment of the present invention, the crankshaft 14 extends in the horizontal or substantially horizontal direction and perpendicular or substantially perpendicular to the direction of the thrust force such that, as compared with the case where a plurality of cylinders 11 are aligned in the forward-rearward direction, an increase in the size of the outboard motor 100 in the forward-rearward direction due to the orientation of the engine 1 is significantly reduced or prevented. The rotational axis of the crankshaft 14 extends in the right-left direction, and compared with the case where the rotational axis of the crankshaft 14 extends in the upward-downward direction (direction Z), vibrations in a steering direction are significantly reduced or prevented. As compared with the case where the rotational axis of the crankshaft 14 extends in the upward-downward direction and the cylinders 11 are aligned in the upward-downward direction, the center of gravity is lowered. Thus, the vessel body 200 on which the outboard motor 100 is mounted is stabilized, and the operability of the outboard motor 100 is improved. The rotational axis of the crankshaft 14 extends in the right-left direction, and thus the rolling of the vessel body 200 on which the outboard motor 100 is mounted is significantly reduced or prevented due to the gyro effect (the effect of stabilizing the attitude of a rotating object). Thus, the attitude of the vessel body 200 is stabilized. The outboard motor 100 includes the first gear 16 disposed on the balance shaft 15 and the second gear 21 to which the decelerated rotational force from the first gear 16 is transmitted. Thus, the rotational speed of the engine 1 is reduced and a decelerated rotational force is transmitted to the propeller 5, and thus the rotational speed of the engine 1 is increased with respect to the upper limit of the rotational speed of the propeller 5 which does not cause cavitation. Consequently, the engine 1 is driven at a higher speed. Thus, the rotational speed is increased such that the output of the engine 1 is increased, and the engine 1 is downsized. The rotational speed of the engine 1 is reduced and transmitted to the propeller 5 such that the rotational speed (idle rotational speed) of the engine 1 during idling is increased, and when the engine 1 is driven at the idle rotational speed, the vessel speed is reduced while a reduction in the amount of power generated is significantly reduced or prevented. This advantageous effect is beneficial when an electronic device such as a fish finder is used while the vessel body 200 trolls at a very low speed, for example. The balance shaft 15 extends in the direction that intersects with the direction in which the cylinder 11 extends and in the downward direction with respect to the crankshaft 14 such that it is not necessary to provide a space to dispose the balance shaft 15 in the direction in which the cylinder 11 extends, and thus an increase in the size of the outboard motor 100 in the forward-rearward direction in which the cylinder 11 extends is further significantly reduced or prevented.

According to a preferred embodiment of the present invention, the rotational speed of the second gear 21 is reduced to about ½ times or more and about 1/1.5 times or less the rotational speed of the first gear 16, for example. Thus, as compared with the case where the rotational speed is not reduced, the engine 1 is rotated at a higher speed, the engine 1 is effectively downsized, and the idle rotational speed is effectively increased.

According to a preferred embodiment of the present invention, the outboard motor 100 includes the gearing 3 that decelerates the rotational speed of the drive shaft 2 and transmits the decelerated rotational force to the propeller 5, and the reduction ratio of the gearing 3, which is the ratio of the output rotational speed to the input rotational speed, is less than the reduction ratios of the first gear 16 and the second gear 21. Thus, the rotational speed of the engine 1 is further reduced and transmitted to the propeller 5 by the gearing 3.

According to a preferred embodiment of the present invention, the gearing 3 reduces the rotational speed of the propeller 5 to about 1/2.5 times or more and about ½ times or less the rotational speed of the drive shaft 2, for example. Thus, the rotational speed of the drive shaft 2 is transmitted to the propeller 5 in a state where the torque is increased.

According to a preferred embodiment of the present invention, the first gear 16 is integral with the balance shaft 15. Thus, the rotational speed of the balance shaft 15 is directly reduced by the first gear 16, and compared with the case where a transmission such as a gear is separately provided, the number of components is reduced, and it is not necessary to provide a space to dispose the transmission such that the engine 1 is downsized.

According to a preferred embodiment of the present invention, each of the first gear 16 and the second gear 21 includes a bevel gear. Thus, the rotational speed of the second gear 21 is reduced while the rotational motion of the first gear 16 about the axis in the horizontal direction is efficiently converted into the rotation motion of the second gear 21 about the axis in the upward-downward direction.

According to a preferred embodiment of the present invention, the engine 1 preferably includes two or less cylinders 11, for example. Thus, an increase in the size of the outboard motor 100 in the right-left direction in which the crankshaft 14 extends is significantly reduced or prevented.

According to a preferred embodiment of the present invention, the engine 1 includes only one cylinder 11. Thus, the outboard motor 100 is effectively downsized in the right-left direction in which the crankshaft 14 extends.

According to a preferred embodiment of the present invention, the engine 1 has an output of about 70 horsepower or less, for example. Thus, the outboard motor 100 having an output of about 70 horsepower or less is downsized in the forward-rearward direction.

According to a preferred embodiment of the present invention, the outboard motor 100 includes the tiller handle 7 that includes the throttle grip 71, which adjusts the accelerator opening degree of the engine 1, and steers the direction of the thrust force. Thus, the outboard motor 100 that the operator manually steers is downsized in the forward-rearward direction, and thus the center of gravity in the forward-rearward direction is closer to the throttle grip 71. Thus, the rotational moment in the steering direction is reduced, and the operator is able to easily steer the outboard motor 100 with a small force.

According to a preferred embodiment of the present invention, the outboard motor 100 includes the bracket 6 that mounts the outboard motor 100 on the vessel body 200, and the first gear 16 and the second gear 21 are disposed above the upper end of the bracket 6. Thus, a speed reducer of the first gear 16 and the second gear 21 is disposed in the upper portion of the outboard motor 100, and thus it is possible to make lower components including the drive shaft 2 common with components of a conventional outboard motor.

According to a preferred embodiment of the present invention, the outboard motor 100 includes the plurality of supports 63*a* and 63*b* connected to the bracket 6 and spaced apart from each other in the upward-downward direction, and the upper supports 63*a* are disposed near the balance shaft 15. Thus, the vibrations of the engine 1 are significantly reduced or prevented by the balance shaft 15, and thus transmission of the vibrations to the upper supports 63*a* disposed near the balance shaft 15 is effectively significantly reduced or prevented.

According to a preferred embodiment of the present invention, the rotational axis of the crankshaft 14 is disposed forward of the rotational axis of the balance shaft 15. Thus, the position of the balance shaft 15 does not protrude forward, and thus an increase in the size of the outboard motor 100 in the forward-rearward direction is easily significantly reduced or prevented.

According to a preferred embodiment of the present invention, the crankshaft 14 is disposed forward of the cylinder 11. Thus, the position of the cylinder 11 does not protrude forward relative to the crankshaft 14 located in a front portion of the outboard motor 100, and thus an increase in the size of the outboard motor 100 in the forward-rearward direction is easily significantly reduced or prevented.

According to a preferred embodiment of the present invention, the cylinder 11 extends at an angular direction within about 30 degrees with respect to the horizontal direction, for example. Thus, the cylinder 11 does not extend excessively in the upward-downward direction, and thus an increase in the height of the center of gravity of the engine 1 is significantly reduced or prevented, and an increase in the size of the outboard motor 100 in the upward-downward direction is significantly reduced or prevented.

According to a preferred embodiment of the present invention, the outboard motor 100 includes the intake pipe 111 that is connected to the cylinder 11 and extends upward, and the exhaust pipe 112 that is connected to the cylinder 11 and extends downward. Thus, the engine 1 efficiently takes in air from above and efficiently discharges exhaust gas downward, the resistance to flow of intake air and exhaust gas is reduced, and the engine 1 is efficiently driven.

According to a preferred embodiment of the present invention, the outboard motor 100 includes the flywheel 17 that is connected to the crankshaft 14 and rotates about the axis in the horizontal or substantially horizontal direction and perpendicular or substantially perpendicular to the propelling direction of the propeller 5. Thus, it is not necessary to elevate the position of the flywheel 17 which has a large mass, and thus the center of gravity of the outboard motor 100 is effectively lowered.

According to a preferred embodiment of the present invention, the engine 1 is able to be rotationally driven at about 7000 rpm or more, for example. Thus, the engine 1 of the outboard motor 100 is driven at a high rotational speed.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while one outboard motor is preferably provided on the vessel body in preferred embodiments described above, the present invention is not restricted to this. A plurality of outboard motors may alternatively be provided on the vessel body.

While only one cylinder is preferably provided in the engine in preferred embodiments described above, the present invention is not restricted to this. Two cylinders may alternatively be provided in the engine. In this case, the two cylinders are aligned in a direction in which the crankshaft extends. Furthermore, three or more cylinders may alternatively be provided in the engine.

While the outboard motors preferably include the tiller handle and are preferably steered by operating the tiller handle in preferred embodiments described above, the present invention is not restricted to this. The outboard motor may alternatively include a steering and be steered by operating the steering.

While the outboard motors preferably include the throttle grip, and the accelerator opening degree of the engine is preferably adjusted by operating the throttle grip in preferred embodiments described above, the present invention is not restricted to this. The outboard motor may alternatively include a remote controller, and the accelerator opening degree may alternatively be adjusted from a position spaced apart from the outboard motor.

While the clamp bracket is preferably fastened and fixed to the vessel body by the bolts and nuts in preferred embodiments described above, the present invention is not restricted to this. The clamp bracket may alternatively be fixed by sandwiching the stern of the vessel body with a vise or the like.

While the outboard motors are each preferably mounted on the rear portion of the vessel body in preferred embodiments described above, the present invention is not restricted to this. The outboard motor may alternatively be provided on a side portion or a front portion of the vessel body.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a cylinder in which a piston reciprocates and a crankshaft to which reciprocating movement of the piston is transmitted as a rotational motion, the crankshaft extending in a horizontal or substantially horizontal direction and perpendicular or substantially perpendicular to a direction of a thrust force of the outboard motor;

a balance shaft disposed in a direction that intersects with a direction in which the cylinder extends and in a downward direction with respect to the crankshaft, the balance shaft extending parallel or substantially parallel to the direction in which the crankshaft extends, the balance shaft receiving a driving force from the crankshaft;

a first gear provided on the balance shaft;

a second gear to which a rotational force from the first gear is transmitted;

a drive shaft connected to the second gear and extending in an upward-downward direction;

a propeller rotated by a driving force of the drive shaft; and a bracket that mounts the outboard motor on a vessel body; wherein the first gear and the second gear are disposed above an upper end of the bracket.

2. The outboard motor according to claim 1, wherein a rotational speed of the second gear is reduced to about ½ times or more and about 1/1.5 times or less than a rotational speed of the first gear.

3. The outboard motor according to claim 2, further comprising a third gear that decelerates a rotational speed of the drive shaft and transmits a decelerated rotational force to the propeller; wherein a reduction ratio of the third gear, which is a ratio of an output rotational speed to an input rotational speed, is less than a reduction ratio of the first gear and a reduction ratio of the second gear.

4. The outboard motor according to claim 3, wherein the third gear reduces a rotational speed of the propeller to about 1/2.5 times or more and about ½ times or less than the rotational speed of the drive shaft.

5. The outboard motor according to claim 1, wherein the first gear is integral with the balance shaft.

6. The outboard motor according to claim 1, wherein the first gear and the second gear each include a bevel gear.

7. The outboard motor according to claim 1, wherein the cylinder includes two or less cylinders.

8. The outboard motor according to claim 7, wherein the cylinder includes only one cylinder.

9. The outboard motor according to claim 1, wherein the engine has an output of about 70 horsepower or less.

10. The outboard motor according to claim 1, further comprising a tiller handle including a throttle grip that adjusts an accelerator opening degree of the engine, the tiller handle steering the direction of the thrust force.

11. The outboard motor according to claim 1, further comprising a plurality of supports connected to the bracket and spaced apart from each other in the upward-downward direction; wherein an upper one of the plurality of supports is disposed near the balance shaft.

12. The outboard motor according to claim 1, wherein the crankshaft is disposed forward of the cylinder.

13. The outboard motor according to claim 1, wherein the cylinder extends at an angular direction within about 30 degrees with respect to the horizontal direction.

14. The outboard motor according to claim 1, further comprising an intake pipe connected to the cylinder and extending upward, and an exhaust pipe connected to the cylinder and extending downward.

15. The outboard motor according to claim 1, further comprising a flywheel connected to the crankshaft and that rotates about an axis extending in the horizontal or substantially horizontal direction and perpendicular or substantially perpendicular to a propelling direction of the propeller.

16. The outboard motor according to claim 1, wherein the engine is able to be rotationally driven at about 7000 rpm or more.

17. An outboard motor comprising:

an engine including a cylinder in which a piston reciprocates and a crankshaft to which reciprocating movement of the piston is transmitted as a rotational motion, the crankshaft extending in a horizontal or substantially horizontal direction and perpendicular or substantially perpendicular to a direction of a thrust force of the outboard motor;

a balance shaft disposed in a direction that intersects with a direction in which the cylinder extends and in a downward direction with respect to the crankshaft, the balance shaft extending parallel or substantially parallel to the direction in which the crankshaft extends, the balance shaft receiving a driving force from the crankshaft;

a first gear provided on the balance shaft;

a second gear to which a rotational force from the first gear is transmitted;

a drive shaft connected to the second gear and extending in an upward-downward direction; and a propeller rotated by a driving force of the drive shaft; wherein a rotational axis of the crankshaft is disposed forward of a rotational axis of the balance shaft.

18. An outboard motor comprising:

an engine including a cylinder in which a piston reciprocates and a crankshaft to which reciprocating movement of the piston is transmitted as a rotational motion, the crankshaft extending in a horizontal or substantially horizontal direction and perpendicular or substantially perpendicular to a direction of a thrust force of the outboard motor;

a balance shaft disposed in a direction that intersects with a direction in which the cylinder extends and in a downward direction with respect to the crankshaft, the balance shaft extending parallel or substantially parallel to the direction in which the crankshaft extends, the balance shaft receiving a driving force from the crankshaft;

a first gear provided on the balance shaft;

a second gear to which a rotational force from the first gear is transmitted;

a drive shaft connected to the second gear and extending in an upward-downward direction; and a propeller rotated by a driving force of the drive shaft; wherein the balance shaft includes an eccentric shaft.

* * * * *